US007013723B2

(12) United States Patent
Ramakrishnan et al.

(10) Patent No.: US 7,013,723 B2
(45) Date of Patent: Mar. 21, 2006

(54) APPARATUS AND METHODS FOR CANCELING THE EFFECTS OF FLUID STORAGE IN DOWNHOLE TOOLS

(75) Inventors: Terizhandur S. Ramakrishnan, Bethel, CT (US); Syed Tariq, Doha (QA); Thomas H. Zimmerman, Ridgefield, CT (US)

(73) Assignee: Schlumberger Technology Corporation, Ridgefield, CT (US)

( * ) Notice: Subject to any disclaimer, the term of this patent is extended or adjusted under 35 U.S.C. 154(b) by 195 days.

(21) Appl. No.: 10/460,841

(22) Filed: Jun. 13, 2003

(65) Prior Publication Data

US 2004/0251021 A1 Dec. 16, 2004

(51) Int. Cl.
*E21B 47/10* (2006.01)

(52) U.S. Cl. ..... 73/152.18

(58) Field of Classification Search ..... 73/152.01, 73/152.18, 152.22, 152.28, 152.29, 152.39
See application file for complete search history.

(56) References Cited

U.S. PATENT DOCUMENTS

| | | | | |
|---|---|---|---|---|
| 2,747,401 | A | 5/1956 | Doll | 73/151 |
| 3,780,575 | A | 12/1973 | Urbanosky | 73/152 |
| 3,952,588 | A | 4/1976 | Whitten | 73/155 |
| 4,507,957 | A | 4/1985 | Montgomery et al. | 73/151 |
| 4,513,612 | A | 4/1985 | Shalek | 73/155 |
| 4,742,459 | A | 5/1988 | Lasseter | 364/422 |
| 4,860,581 | A | 8/1989 | Zimmerman et al. | 73/155 |
| 5,247,830 | A | 9/1993 | Goode | 73/155 |
| 5,269,180 | A | 12/1993 | Dave et al. | 73/152 |
| 5,335,542 | A | 8/1994 | Ramakrishnan et al. | 73/152 |
| 6,719,049 | B1 * | 4/2004 | Sherwood et al. | 166/264 |

OTHER PUBLICATIONS

Goode, P. A. and Thambynayagam, R.K.M. *Permeability Determination with a Multiprobe Formation Tester*. SPE 20737 Formation Evaluation, (1992) pp. 297-303.

Goode, P. A., Pop, J. J., and Murphy III, W. F. *Multiple Probe Formation Testing and Vertical Reservoir Continuity*. SPE 22738 presented at the SPE Annual Technical Conference and Exhibition, Dallas (Oct. 1991).

Ramakrishnan, T. S. et al. *A Laboratory Investigation of Permeability in Hemispherical Flow with Application to Formation Testers*. SPE 22689 Formation Evaluation (1995) vol. 10, pp. 99-108.

RFT: Essentials of Pressure Test Interpretation, Schlumberger 1981.

Wilkinson, D. and Hammond, P. *A Perturbation Method for Mixed Boundary-Value Problems in Pressure Transient Testing*. Transport in Porous Media 5 (1990), pp. 609-636.

* cited by examiner

*Primary Examiner*—Hezron Williams
*Assistant Examiner*—Rodney Frank
(74) *Attorney, Agent, or Firm*—Jody Lynn DeStefanis; David P. Gordon; Dale Gaudier

(57) ABSTRACT

The effects of storage on the interpretation of data obtained at observation probes of a borehole tool are eliminated by controlling the storage volumes relative to the observation probes. For a homogeneous medium, the effect of storage on the interpretation of data is eliminated by causing the flow line volumes connected to each observation probe to be equal to each other. For a heterogeneous medium, the effect of storage on the interpretation of data is eliminated by causing the flow line volumes to vary in proportion to the relative permeabilities of the strata of the heterogeneous medium adjacent the probes. The borehole tool is provided with mechanisms for conducting flow line volume adjustment.

21 Claims, 4 Drawing Sheets

APPARATUS AND METHODS FOR CANCELING THE EFFECTS OF FLUID STORAGE IN DOWNHOLE TOOLS

BACKGROUND OF THE INVENTION

1. Field of the Invention

The present invention relates broadly to apparatus and methods for investigating subsurface earth formations. More particularly, this invention relates to borehole tools and methods for making hydraulic property measurements of an earth formation surrounding a borehole, and in particular apparatus and methods for generating appropriate pressure-pressure response functions in homogeneous and heterogeneous formations.

2. State of the Art

The determination of permeability (fluid mobility) and other hydraulic properties of formations surrounding boreholes is very useful in gauging the producibility of formations, and in obtaining an overall understanding of the structure of the formations. For the reservoir engineer, permeability is generally considered a fundamental reservoir property, the determination of which is at least equal in importance with the determination of porosity, fluid saturations, and formation pressure. When obtainable, cores of the formation provide important data concerning permeability. However, cores are difficult and expensive to obtain, and core analysis is time consuming and provides information about very small sample volumes. In addition, cores, when brought to the surface, may not adequately represent downhole conditions. Thus, in situ determinations of permeability which can quickly provide horizontal and vertical determinations of permeabilities over larger portions of the formation are highly desirable.

Existing techniques for making permeability determinations can be classified into indirect and direct methods. In indirect methods, permeability is determined from empirical correlations which attempt to express permeability in terms of other measured formation parameters, such as porosity, saturation, or mineralogy. A direct measurement technique involves actual measurement of fluid flow, pressure, etc. and determination of permeability from these measurements.

Suggestions regarding a direct in situ determination of permeability via the injection or withdrawal of fluid into or from the formation and the measurement of pressures resulting therefrom date back at least to U.S. Pat. No. 2,747,401 to Doll (1956). In the Doll patent there is disclosed a method and apparatus for determining hydraulic characteristics, including permeability, fluid pressure, and hydraulic anisotropy, of formations surrounding a borehole. A pressure gradient is obtained in the formations by pressing or pushing a probe against the borehole wall. Pressure differences between different points are then used to obtain indications of hydraulic characteristics of the formations. In an embodiment disclosed in the patent, a pair of spaced probes are pressed against the formation, and a pressure gradient is generated by injecting a fluid into the formation at one of the probes (a source probe) at a constant flow rate. The other probe (a measurement probe) is coupled to a pressure responsive device. Pressure is measured at the measurement probe before and after injection of the fluid at the source probe. The permeability of the formation is then obtained using a formula in which permeability is proportional to viscosity times flow rate divided by the change in pressure. The patent points out that the pressure gradient can also be obtained by extracting fluid from the formation and that measurements can be made in more than one direction; e.g., vertical and horizontal, to obtain indications of both vertical and horizontal hydraulic characteristics.

Different devices have been used for making direct measurements of permeability. For example, devices whose primary use has been for sampling formation fluids, have also been used with some success in estimating formation permeability. Formation testing devices which can take repeated samples are disclosed, for example, in U.S. Pat. No. 3,780,575 to Urbanosky and U.S. Pat. No. 3,952,588 to Whitten, both of which are hereby incorporated by reference herein in their entireties. In these devices, a hydraulic pump provides pressure for the operation of various hydraulic systems in the device. Sample chambers are provided in the tool to take samples of formation fluid by withdrawing hydraulically operated pistons. Pressure transducers are provided to monitor pressure as the fluid is withdrawn, and pressure can be continuously recorded. So-called pre-test chambers are also typically provided and are operated to permit more reliable flow during the subsequent fluid withdrawal. Filters can also be provided to filter sand and other particulate matter, and pistons can be provided to clean the filters, such as when the tool is retracted.

One type of formation testing device includes an elongated body and a setting arm activated by setting pistons which are used to controllably urge the body of the device against a side of the borehole wall at a selected depth. The side of the device that is urged against the borehole wall includes a packer which surrounds a probe. As the setting arm extends, the probe is inserted against the formation, and the packer then sets the probe in position and forms a seal around the probe, whereupon the fluids can be withdrawn from the formation during pre-test and the actual test.

The primary technique presently used for in situ determination of permeability is the "drawdown" method where a probe of a formation testing tool is placed against the borehole wall, and the pressure inside the tool (e.g., at a chamber) is brought below the pressure of the formation, thereby inducing fluids to flow into the formation testing tool. By measuring pressures and/or fluid flow rates at and/or away from the probe, and processing those measurements, determinations regarding permeability are obtained. These determinations, however, have typically been subject to large errors. Among the reasons for error include the fact that if fluid is extracted at a fixed flow rate which is independent of permeability, as is typically done, in low permeability formations the pressure drop tends to be too large, and solution gas and/or water vapor forms and can make the results uninterpretable. Indeed, liberation of gas during drawdown provides anomalous pressure and fluid flow rate readings. Another source of error is the damage to the formation (i.e., pores can be clogged by migrating fines) which occurs when the fluid flow rate towards the probe is caused to be too large. See, e.g., T. S. Ramakrishnan et al., "A Laboratory Investigation of Permeability in Hemispherical Flow with Application to Formation Testers", *SPE Form. Eval.* 10, pp. 99–108 (1995).

More recent patent disclosures of permeability testing tools include U.S. Pat. No. 4,742,459 to Lasseter, and U.S. Pat. No. 4,860,581 to Zimmerman et al. (both of which are hereby incorporated by reference herein in their entireties) which further develop the draw-down techniques. In the Lasseter patent, a logging device is provided having a source probe, a horizontal observation probe which is azimuthally displaced on the borehole wall with respect to the source probe position, and a vertical observation probe which is vertically displaced on the borehole wall with respect to the source probe position. The source probe is provided with means for withdrawing fluid at a substantially constant rate or pressure, while the vertical and horizontal probes, as well as the source probe, are provided with means for measuring formation pressure response as a function of time. According to the method for determining permeability, a transient pressure change is established in the formation by withdrawing fluid from the formation at the source probe location. The formation pressure response is then measured at the vertical and horizontal probes. By selecting a trial permeability value, theoretical formation pressure responses can be derived as a function of time at the probe locations. The theoretical formation pressure responses are then compared with the actually measured pressure responses in an iterative manner, with the difference being used as feedback to modify the trial value, until the difference is negligible.

The Zimmerman et al. patent mentions that in the drawdown method, it is essential to limit the pressure reduction so as to prevent gas liberation. In order to prevent gas liberation, Zimmerman et al. propose a flow controller which regulates the rate of fluid flow into the tool.

Additional progress in in situ permeability measurement is represented by U.S. Pat. No. 5,269,180 to Dave et al., U.S. Pat. No. 5,335,542 to Ramakrishnan et al., and U.S. Pat. No. 5,247,830 to Goode, all of which are hereby incorporated by reference herein in their entireties. In the Dave et al. patent, borehole tools, procedures, and interpretation methods are disclosed which rely on the injection of both water and oil into the formation whereby endpoint effective permeability determinations can be made. In the Ramakrishnan et al. patent, a tool which integrates hydraulic and electromagnetic measurements (images) is disclosed. In the Goode patent, methods are disclosed for making horizontal and vertical permeability measurements without the necessity for measuring flow rate into or out of the borehole tool. In particular, an interpretation scheme is presented in which the change in pressure at the vertical observation probe is related to the change in pressure at the horizontal probe through a convolutional integral. The kernel function G in this integral is independent of the flowrate at the sink probe. This scheme is called pressure-pressure deconvolution, and it eliminates the need for knowing the tool storage volume (i.e., the volume of fluid in the tool connected to the formation) and the formation damage at the sink probe. However, the problem of storage at the observation probes remains and can be a source of error in the interpretation because the local flow at each observation probe causes a pressure change that cannot be neglected. Thus, even with these inventions which have advanced the art significantly, the accuracy and scope of the information obtained is not to the level desired.

SUMMARY OF THE INVENTION

It is therefore an object of the invention to provide apparatus and methods for conducting accurate measurements of hydraulic properties of an earth formation.

It is another object of the invention to provide apparatus and methods for generating appropriate pressure-pressure response functions in homogeneous and heterogeneous formations.

It is a further object of the invention to provide methods and apparatus for eliminating storage effects in pressure-pressure deconvolutional analysis.

It is an additional object of the invention to provide a modified pressure-pressure deconvolution for improved stability.

Another object of the invention is to provide apparatus and methods eliminating storage effects without requiring additional testing of the formation.

In accord with the objects of the invention, the effects of storage on the interpretation of data obtained at the observation probes can be eliminated by controlling the storage volumes relative to the observation probes. For a homogeneous medium, the effect of storage on the interpretation of data from the observation probes may be eliminated by causing the flow line volumes connected to each observation probe to be equal to each other. For a heterogeneous medium, the effect of storage on the interpretation of data from the observation probes may be eliminated by causing the flow line volumes to vary in proportion to the permeabilities of the strata of the heterogeneous medium adjacent the probes. The borehole tool of the invention is therefore provided with means for conducting flow line volume adjustment. Thus, where the vertical observation probe is located in one stratum (layer) of the formation having a first permeability and the horizontal observation probe is located in another stratum having a second permeability, based on local drawdown permeabilities estimated in pretest procedures, the flow line volumes connected to the respective observation probes are adjusted in order to remove the effect of storage on the interpretation of data during testing.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
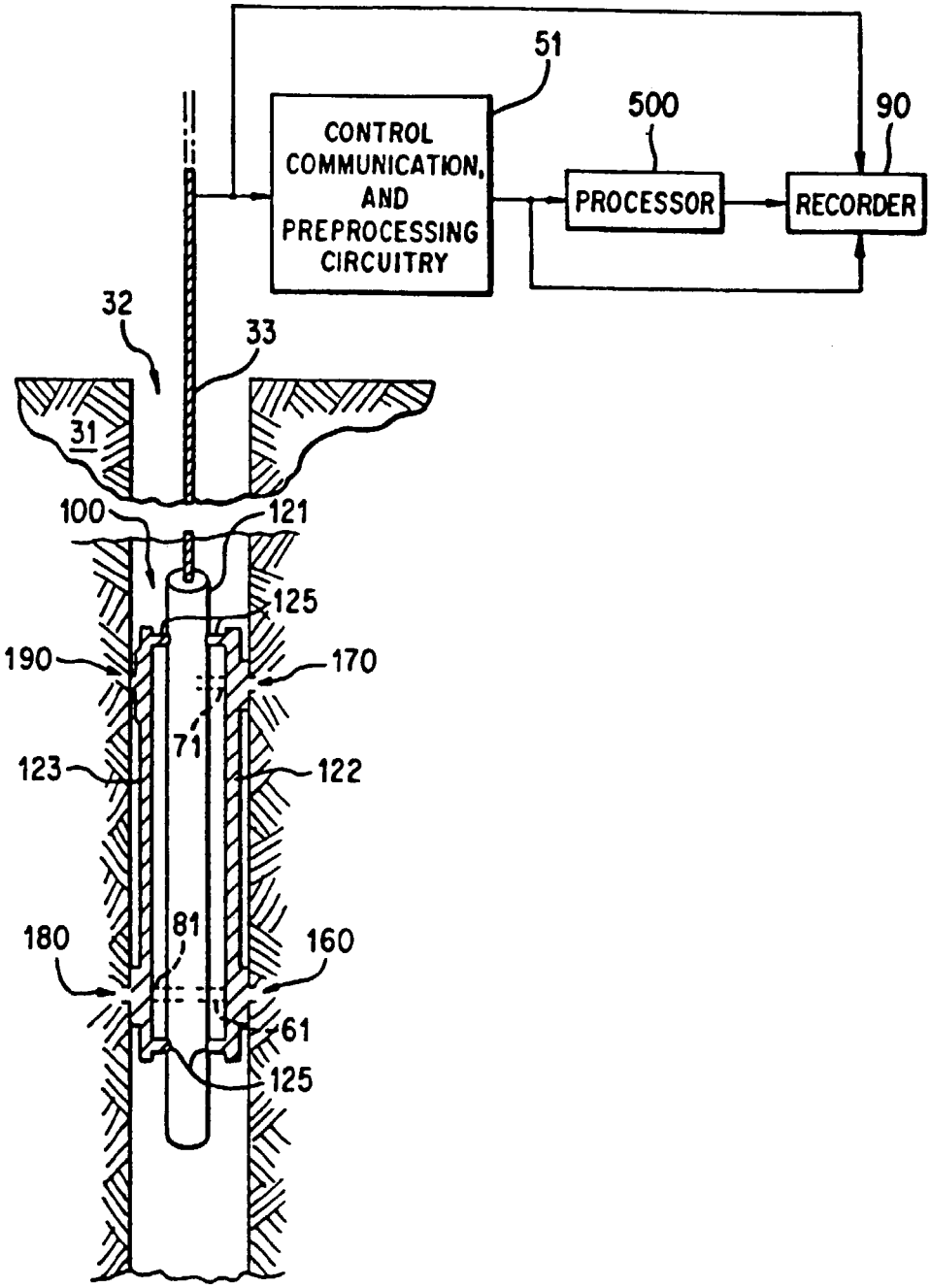
FIG. 1 is a diagram, partially in schematic form, of an apparatus in accordance with an embodiment of the invention which can be used to practice an embodiment of the method of the invention.

An apparatus 100 for investigating subsurface formations 31 traversed by a borehole 32 is seen in FIG. 1. Typically, the borehole 32 is filled with a drilling fluid or mud which contains finely divided solids in suspension. The investigating apparatus or logging device 100 is suspended in the borehole 32 on an armored multiconductor cable 33, the length of which substantially determines the depth of the device 100. A known depth gauge apparatus (not shown) is provided to measure cable displacement over a sheave wheel (not shown) and thus record the depth of the logging device 100 in the borehole 32. The cable length is controlled by suitable means at the surface such as a drum and winch mechanism (not shown). Circuitry 51, shown at the surface of the formation, although portions thereof may be downhole, represents control, communication and preprocessing circuitry for the logging apparatus. This circuitry may be of known type, and is not, per se a novel feature of the present invention.

The preferred logging device 100 has an elongated body 121 which encloses the downhole portion of the device controls, chambers, measurement means, etc. Arms 122 and 123 are mounted on pistons 125 which extend, under control from the surface, to set the tool. Mounted on the arm 122 are a source probe 160, and spaced above and vertically therefrom, a vertical observation probe 170. Mounted on the arm 123 is a horizontal observation probe 180. The arm may also contain a further measuring device, such as an electrical microresistivity device at the position 190. Conduits 61, 71, and 81 are provided and are slidably mounted in body 121 for communication between the probes 160, 170, and 180, respectively, and the body 121.

As is disclosed in previously incorporated U.S. Pat. No. 4,742,459, the source probe 160 preferably comprises either a fluid sink or a fluid source which includes a packer 161 with a fluid-carrying line that communicates with the formation when the packer is set. The present invention is not dependent on use of a particular type of mechanical means for withdrawing fluid from or injecting fluid into the formations, as any of numerous such device well known in the art may be utilized.

Figure 2:
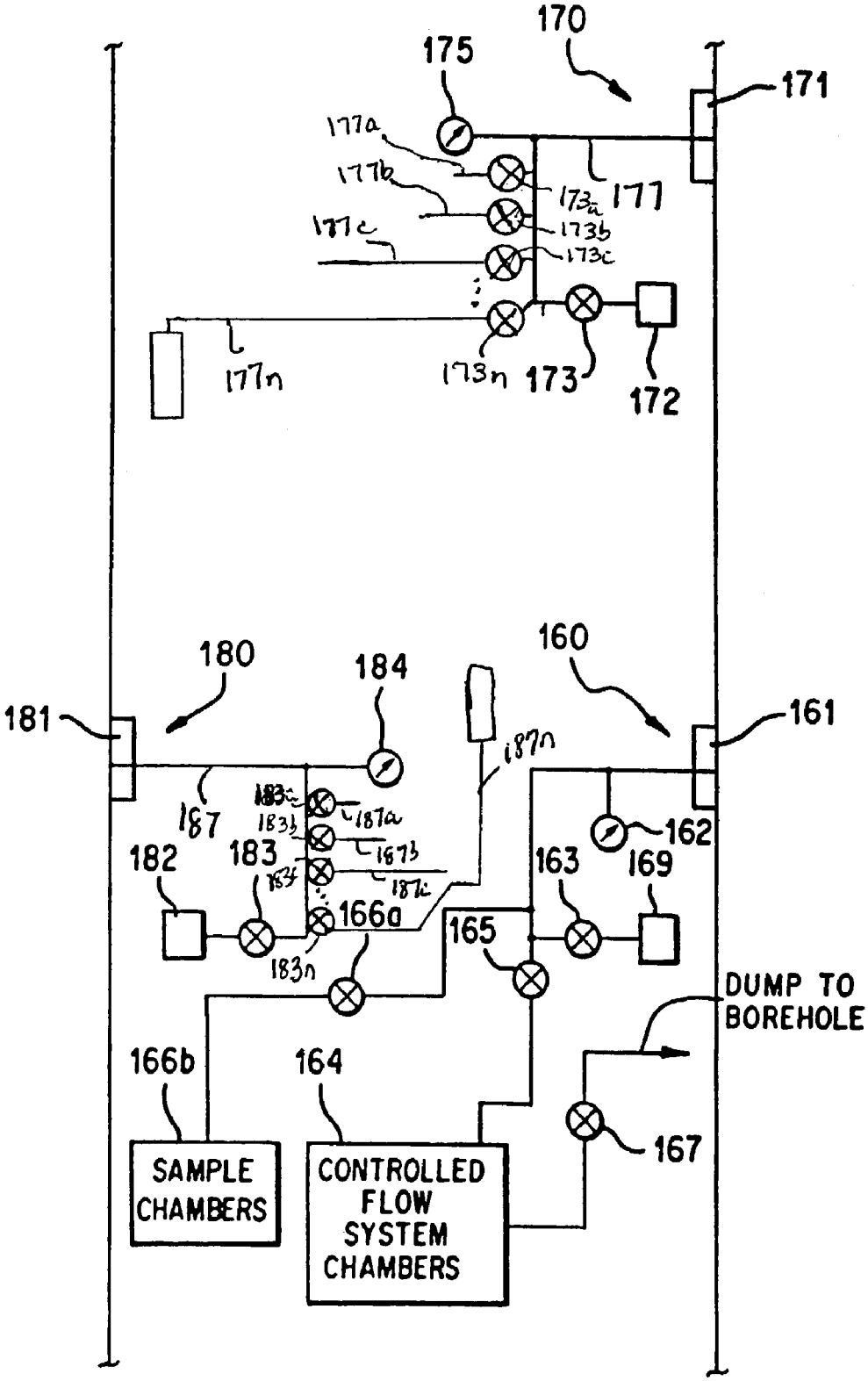
FIG. 2 is a diagram, partially in schematic form, of portions of the logging device of FIG. 1.

As seen in FIG. 2, a pretest chamber 169 is accessed via a valve 163. A controlled flow system with chambers 164 is accessible via valve 165. The control of sample dump to the borehole is via valve 167. In addition, valve 166*a* is provided along with sample chambers 166*b* to permit storage of samples to be brought to the surface of the formation. A pressure measurement device 162 such as a strain gauge type of pressure meter is provided to monitor pressure at the probe. In accord with the preferred embodiment of the invention, and as described in previously incorporated U.S. Pat. No. 5,247,830 to Goode, no flow rate meter is required as flow rate is not used in making determinations of the hydraulic properties of the formation according to the preferred embodiment of the invention.

The vertical observation probe 170 comprises a packer 171 with an observation port or probe that engages the borehole, and communicates via fluid conduit (also called "flow line") 177 with a pretest chamber 172 via a valve 173. A high resolution high-accuracy pressure meter 175, such as of the quartz piezoelectric type, is preferably provided to monitor the pressure at the probe. Extending from flow line 177 are a plurality of branch flow lines 177*a*–177*n*. Each branch flow line is coupled to the main flow line 177 via valves 173*a*–173*n*. In this manner, as will be discussed in greater detail hereinafter, the fluid storage volume associated with the probe 170 may be adjusted. Each branch flow line 177*a*–177*n* may be a dead-end line, and if desired, each branch flow line 177*a*–177*n* may be of equal size and hold an equal volume of fluid. Alternatively, the flow lines may hold different amounts of fluid, and/or one or more of the flow lines may be coupled to a fluid chamber (not shown) which can hold a substantial amount of fluid. As another alternative, a single branch flow line may be provided with multiple valves in series along the branch flow line. In this manner, valves may be opened in sequence to provide a desired storage volume for the probe. In any event, it is desirable that the storage volume fluidly coupled to the probe be adjustable by means of the branch flow line(s) so that the storage volume can be increased by a factor of ten or even one hundred relative to the storage volume when all branch flow lines are closed. Depending upon the arrangement of the branch flow line(s), (i.e., whether multiple branch flow lines are used and whether they are all equal in volume), the step may be larger or smaller. Thus, for example, using eleven branch flow lines (177*a*–177*k*) having storage volumes equal to 1/16, 1/8, 1/4, 1/2, 1, 2, 4, 8, 16, 32, and 64 times the storage volume of flow line 177, and by controlling the valves which couple and decouple the branch flow line to the main flow line, the total storage for the probe may be increased in steps of 6.25% to an amount over one hundred times (10,000%) the storage volume of the probe.

According to the preferred embodiment of the invention, the flow lines 177*a*–177*n* (and preferably main flow line 177) are either filled (primed) with a liquid such as water or oil prior to placing the tool in the borehole, or the flow lines are provided with additional valves (not shown) which permit the lines to be flushed with reservoir fluid or with fluid carried downwhole (as described in the previously incorporated Dave et al. U.S. Pat. No. 5,269,180). Where the flow lines are filled with liquid prior to placement downhole, according to the preferred embodiment of the invention, it is preferred that the main flow line 177 still be provided with an additional valve to permit flushing of the main flow line.

The horizontal observation probe 180 is of similar construction to the vertical observation probe and includes a packer 181 with an observation port or probe that engages the borehole and communicates via a fluid conduit 187 with the pretest chamber 182 and valve 183. A pressure measuring means 184 is also coupled to the fluid conduit 187. Preferably, the fluid conduit 187 is of exactly the same storage capacity as the fluid conduit 177 associated with probe 170. In addition, the fluid conduit 187 is also preferably provided with a plurality of branch flow lines 187*a*–187*n* which are coupled thereto via valves 183*a*–183*n*. In this manner, as will be discussed in greater detail hereinafter, the fluid storage volume associated with the probe 180 may be adjusted. Despite the preference of a quartz piezoelectric type pressure meter, the present invention is not dependent on use of a particular device for taking pressure measurements, as many such devices (e.g., a strain gauge or sapphire sensor) are well known in the art.

As with branch flow lines 177*a*–177*n*, branch flow lines 187*a*–187*n* (and preferably main flow line 187) are either filled with a liquid such as water or oil prior to placing the tool in the borehole, or the flow lines are provided with additional valves (not shown) which permit the lines to be flushed with reservoir fluid or with fluid carried downwhole. In this manner, the fluids contained in each of the probes 170, 180 are matched.

The mechanical elements of the system are controlled from the surface of the earth hydraulically and electrically in a known fashion. Likewise, the pressure at the source probe and the observation probes are monitored and transmitted to the surface of the earth for recording in known manners.

The signal outputs of block 51 are illustrated as being available to processor 500 which, in the present embodiment, is implemented by a general purpose digital computer. It will be understood, however, that a suitable special purpose digital or analog computer could alternatively be employed. Also, it will be recognized that the processor may be at a remote location and receive inputs by transmission of previously recorded signals. The outputs of the computing module 500 are values or value-representative signals for formation hydraulic properties, developed in accordance with techniques described hereinbelow. These signals are recorded as a function of depth on recorder 90, which generically represents graphic, electrical and other conventional storage techniques.

In operation, at a depth level at which measurements are to be taken, the pistons 125 are extended and the tool is set. Under control from the surface, a pretest is then performed at the source probe 160 and the observation probes 170 and

180. The function of the pretest is to flush out mud or mud cake from between the source and observation probes and the formation so as to ensure good hydraulic seals and communication with the formation. During pretest, the fluid lines of the borehole tool are generally flushed to remove borehole fluid and mud. However, for purposes of the present invention, the pretest may also function in a manner well known in the art to obtain an estimate of permeabilities of the formation adjacent each of the probes. See, e.g., "RFT: Essentials of Pressure Test Interpretation", Schlumberger, 1981.

Based on the rough estimates of the formation permeability adjacent the observation probes 170, 180, the relative fluid storage of flow lines 177, 187 may be adjusted by opening appropriate valves chosen from valves 173*a*–173*n* and 183*a*–183*n*. In particular, if the estimates of formation permeability adjacent the observation probes 170, 180 indicate that the tool is located in a homogeneous formation or a homogeneous portion of the formation (i.e., the estimates are equal), none of the valves 173*a*–173*n* and 183*a*–183*n* are opened as flow lines 177 and 187 are designed to have the same storage capacity. Thus, according to the invention, the storage effects on the pressure-pressure deconvolution will be effectively canceled as will be discussed in detail hereinafter. However, if the permeability estimates resulting from the pretest indicate that the tool is in a heterogeneous portion of the formation (i.e., the estimates are different), according to the invention, one or more of valves 173*a*–173*n* and 183*a*–183*n* are opened so that the ratio of the storage capacities of the flow lines 177 and 187 (including the branch flow lines in fluid communication therewith) is substantially equal to the ratio of the permeability estimates.

It should be appreciated that because the process of pretesting can cause different types of fluids to enter flow lines 177 and 187, it may be desirable to flush flow lines 177 and 187 with formation fluids or fluids carried downhole before opening any of valves 173*a*–173*n* or 183*a*–183*n* and continuing.

The pretest (and any flushing) is followed by a withdrawal ("drawdown") of the formation fluids into the sink probe line of the borehole tool. Drawdown is done at a constant flow rate if possible, and pressure measurements are typically taken at the source probe 160 and at observation probes 170 and 180. Drawdown is accomplished by opening valve 165 and initiating the pressure controlled subsystem 164 to withdraw fluid from the formation. Fluid is withdrawn or injected at a substantially controlled pressure or rate. The valve is then closed at the time designated as the shut-in time. During this time, and for a predetermined time after shut-in time, the pressure at the source probe and at each observation probe is measured by the respective pressure gauges and sent to the surface of the earth where the measured pressures are recorded. Flow due to the compression of the fluid in the tool continues following shut-in. Typically, although not necessarily, pressure signals are sampled at a period of 0.1 seconds, converted to digital form, and sent to the surface for recording. Accordingly, there is available at the surface a record of the pressure as a function of time at the source probe and each of the observation probes. There are various available devices and techniques for withdrawing fluid from the formations at substantially constant pressure; examples being set forth in U.S. Pat. Nos. 4,507,957 or 4,513,612. In addition, there are various available techniques for interpreting the data resulting from the drawdown tests. According to the invention, the preferred methods for interpreting the data are set forth in previously incorporated U.S. Pat. No. 5,247,830 to Goode.

If, based on measurements obtained during drawdown, it is desired to take fluid samples, the source probe is activated by opening valve 166*a* and fluid is withdrawn from the formation for a given time or until a particular amount of fluid has been withdrawn. No flow rate measurement is made. Pressure measurements at the source probe as well as at the observation probes are taken during sampling, and these measurements are sent uphole as hereinbefore indicated with respect to the measurements made during drawdown.

It should be noted that before sampling, if desired, a pumping module (not shown) may be used to pump fluids via the probe (sink) into the borehole, and at a desired time, divert the flow into a sampling chamber.

Having described the apparatus and procedure of the invention, an understanding of the underlying theoretical basis of the invention is in order. The convolution integral is widely used for solving time-dependent boundary value problems in variable rate well test analysis. For the pressure response $p_v(t)$ at the vertical observation probe 170, the convolution integral can be written as:

$$p_v(t) = \int_0^t q_s(\tau)G_{vs}(t-\tau)d\tau + \int_0^t q_v(\tau)G_{vv}(t-\tau)dr + \int_0^t q_h(\tau)G_{vh}(t-\tau)d\tau, \tag{1}$$

where G represents the response functions with the first subscript denoting the observation point and the second subscript denoting the source, q represents actual flowrates, and the subscripts s, v, and h denoting the sink probe 160, vertical probe 170 and horizontal probe 180 respectively. No specification of G is made other than requiring that the response be linear.

For a slightly compressible fluid of isothermal compressibility c, the law of mass conservation yields:

$$q_v(t) = -cV_v\frac{dp_v}{dt},\quad q_h(t) = -cV_h\frac{dph}{dt},\ \text{and}\quad q_s(t) - q(t) = -cV_s\frac{dp_s}{dt} \tag{2}$$

where V is the tool volume and q(t) is the imposed drawdown rate at the sink. Substituting the equalities of equations (2) into equation (1) results in:

$$p_v(t) = \int_0^t q_s(\tau)G_{vs}(t-\tau)d\tau - \int_0^t cV_s\frac{dp_s}{d\tau}G_{vs}(t-\tau)dt - \int_0^t cV_v\frac{dp_v}{d\tau}G_{vv}(t-d\tau) - \int_0^t cV_h\frac{dp_h}{d\tau}G_{vh}(t-\tau)dt. \tag{3}$$

Similar expressions may be written for the pressure responses $p_h(t)$ and $p_s(t)$.

The following dimensionless variables may now be defined:

$$p_{vD} = p_v \frac{kl}{Q\mu}$$

$$p_{hD} = p_h \frac{kd}{Q\mu}$$

$$p_{sD} = p_v \frac{kr_p}{Q\mu}$$

$$t_D = t \frac{k}{\phi\mu c l^2}$$

$$q_D = \frac{q}{Q}$$

with the following dimensionless response function being $$G_{vsD} = \frac{G_{vs}}{\frac{\mu}{kl}} \frac{\phi\mu c l^2}{k}$$

$$G_{hsD} = \frac{G_{hs}}{\frac{\mu}{kd}} \frac{\phi\mu c l^2}{k}$$

$$G_{vhD} = \frac{G_{vh}}{\frac{\mu}{kl}} \frac{\phi\mu c l^2}{k} \text{ and}$$

$$G_{ssD,vvD,hhD} = \frac{G_{ss,vv,hh}}{\frac{\mu}{kr_p}} \frac{\phi\mu c l^2}{k}$$

In the above expressions, Q is a characteristic rate, 1 is the distance between the sink and the vertical probe, d is an effective distance between the horizontal probe and the sink as defined in detail hereinafter, and $r_p$ is the probe radius. A characteristic permeability k has been chosen for the purpose of nondimensionalization.

Substituting the above dimensionless parameters into equation (3) and simplifying yields:

$$P_{vD}(t_D) = \int_0^{t_D} q_D(\tau) G_{vsD}(t_D - \tau) d\tau - \left[\frac{V_s}{\phi l^2 r_p}\right] \int_0^{t_D} \frac{d p_{sD}}{d\tau} G_{vsD}(t_D - \tau) d\tau - \left[\frac{V_v}{\phi l^2 r_p}\right] \int_0^{t_D} \frac{d p_{vD}}{d\tau} G_{vvD}(t_D - \tau) d\tau - \left[\frac{V_h}{\phi l^2 d}\right] \int_0^{t_D} \frac{d p_{hD}}{d\tau} G_{vhD}(t_D - \tau) d\tau. \quad (4)$$

If the nondimensional storage related constants are denoted by κ, then $\kappa_s = V_s/\Phi 1^2 r_p$, $\kappa_h = V_h/\phi 1^2 r_p$, $\kappa_v = V_v/\Phi 1^2 r_p$, $\delta = r_p/d$, and $\epsilon = r_p/1$. It is useful to note that $r_p/1$ and $r_p/d$ are much smaller than 1.

Laplace transformation of equation (4) with $t_D \rightarrow s_D$ gives $$\overline{P}_{vD}(s_D) = \overline{G}_{vsD}(s_D)\overline{q}_D(s_D) - s_D\kappa_s \overline{G}_{vsD}(s_D)\overline{P}_{sD}(s_D) - s_D\kappa_v \overline{G}_{vvD}(s_D)\overline{P}_{vD}(s_D) - \delta s_D \kappa_h \overline{G}_{vhD}(s_D)\overline{P}_{hD}(s_D) \quad (5)$$

where the transformed variables are denoted by the elevated bar (¯). Rearranging equation (5) yields $$\overline{p}_{sD}[s_D\kappa_s G_{vsD}] + \overline{p}_{hD}[\delta s_D \kappa_h G_{vhD}] + \overline{p}_{vD}[1 + s_D\kappa_v G_{vvD}] = \overline{G}_{vsD}\overline{q}_D \quad (6)$$

Similar expressions for the horizontal and sink probes are:

$$\overline{p}_{sD}[s_D\kappa_s G_{hsD}] + \overline{p}_{hD}[1 + s_D\kappa_h \overline{G}_{hhD}] + \overline{p}_{vD}\left[\frac{\varepsilon^2}{\delta} s_D \kappa_v \overline{G}_{hvD}\right] = \overline{G}_{hsD}\overline{q}_D \quad (7)$$

and $\overline{P}_{sD}[1 + s_D\kappa_s G_{ssD}] + \overline{P}_{hD}[\delta^2 s_D \kappa_h \overline{G}_{shD}] + \overline{P}_{vD}[\epsilon^2 s_D \kappa_v \overline{G}_{vsD}] = \overline{G}_{ssD}\overline{q}_D$ (8)

By neglecting terms on the order of (δ), (ϵ), ($\delta^2$), and ($\epsilon^2$), in equations 6, 7, and 8 and explicitly solving for observation probe pressures, the following is obtained:

$$\overline{p}_{vD} \frac{\overline{G}_{vsD}\overline{q}_D}{[1 + s_D\kappa_v \overline{G}_{vvD}][1 + s_D\kappa_s \overline{G}_{ssD}]} \text{ and} \quad (9)$$

$$\overline{p}_{hD} \frac{\overline{G}_{hsD}\overline{q}_D}{[1 + s_D\kappa_h \overline{G}_{hhD}][1 + s_D\kappa_s \overline{G}_{ssD}]} \quad (10)$$

Dividing equation (9) by equation (10) yields:

$$\frac{\overline{p}_{vD}}{\overline{p}_{hD}} = \frac{\overline{G}_{vsD}}{\overline{G}_{hsD}} \frac{[1 + s_D\kappa_h \overline{G}_{hhD}]}{[1 + s_D\kappa_v \overline{G}_{vvD}]} \quad (11)$$

For testing of a formation with a multiprobe module such has been described herein, equation (11) suggests that the effect of storage volume connected to the vertical and the horizontal observation probes will cancel out if $\kappa_h = \kappa_v$ and $\overline{G}_{hhD} = \overline{G}_{vvD}$. The condition $\overline{G}_{hhD} = \overline{G}_{vvD}$ is satisfied if the vertical and the horizontal probes are geometrically similar and are set in a medium of similar properties (e.g., in a homogeneous medium). Even in a layered medium of alternating permeabilities the condition is met if both of the probes are set in similar streaks. If the layering is extremely fine, but the medium behaves as a homogeneous anisotropic medium in all the length scales of interest, the condition of $\overline{G}_{hhD} = \overline{G}_{vvD}$ is met as well. The requirement that $\kappa_h = \kappa_v$ or ($V_v = V_h$) means that the flow line volume connected to the observation probes should be equal. Thus, according to the invention, flow lines 177 and 187 are preferably chosen to be of equal length and diameter so that the storage volume between the probe 171 and valve 173 is equal to the storage volume between probe 181 and valve 183.

With $\kappa_h = \kappa_v$, equation (11) reduces to $$\frac{\overline{p}_{vD}}{\overline{p}_{hD}} = \frac{\overline{G}_{vsD}}{\overline{G}_{hsD}} \quad (12)$$

With $$\overline{G} = \frac{\overline{G}_{vsD}}{\overline{G}_{hsD}},$$

it follows that $$p_{vD}(t_D) = \int_0^{t_D} p_{hD}(\tau) G(t_D \tau) d\tau \text{ where} \quad (13)$$

-continued $$G = L^{-1}\left[\frac{\overline{G}_{vsD}}{\overline{G}_{hsD}}\right] \tag{14}$$

The function G(t) depends only on the geometry and the rock/fluid properties of the formation. It has diagnostic value for flow regime identification which is necessary to choose the correct inverse model for parameter estimation as set forth in previously incorporated U.S. Pat. No. 5,247,830 to Goode. The above analysis shows that a source of error in model identification and in the estimation of horizontal and vertical mobilities can be removed by equalizing the storage volumes at the monitor probes.

According to Goode, for system identification, one would normally deconvolve equation (13) to numerically calculate G and compare with known system behaviors. Inversion of equation (13) is numerically stable only if the vertical probe response "lags" that of the horizontal probe. When $k_v$ is larger than $k_h$ (e.g., in a formation with vertical microfractures) this is not necessarily the case and a modification of the G function to $$\hat{G} = L^{-1}\left[\frac{\overline{G}_{vsD}}{\overline{G}_{hsD} + \overline{G}_{vsD}}\right] \tag{15}$$

would ensure that the numerator never leads the denominator signal.

In order to demonstrate the effectiveness of the modification, it is not necessary to model the details of the wellbore geometry and the formation. It is sufficient to consider response functions which are very similar to the proposed tool. This is achieved through the following approximations.

Regarding the self-response function such as Gss, Gvv, and Ghh, the presence of the wellbore is important since the radius of the probe $r_p$ is much smaller than the radius of the wellbore $r_w$. Thus, the probe acts as though it is a source or sink in a flat plate. See, Wilkinson, D. and Hammond, P.: "A Perturbation Method for Mixed Boundary-Value Problems in Pressure Transient Testing", *Trans. Porous Media*, (1990) 5, p. 609–636, and Ramakrishnan, T. S. et al.: "A Laboratory Investigation of Permeability in Hemispherical Flow with Application to Formation Testers", *SPE Form. Eval.* (1995) 10, p. 99–108. However, this boundary value problem is of mixed-nature and cannot be exactly solved. For time scales larger than that required for pressure diffusion to propagate a few probe radii, the infinite time result may be used with the assumption of the transient being a point sink. This is equivalent to using an "effective probe radius" $=(2/\pi)r_p$. Solving the diffusion equation with a point sink on a flat plate, and observing the pressure at $(2/\pi)r_p$ yields:

$$\overline{G}_{ss}, \overline{G}_{vv}, \overline{G}_{hh} = \frac{\mu}{4kr_p}\exp\left[-\sqrt{\frac{\phi\mu cs}{k}}\, r_p\right] \tag{16}$$

In contrast, since the vertical probe is far away form the sink, and $l \gg r_w$, as an observation probe, the presence of wellbore is secondary. Thus, for the response function $\overline{G}_{vs}$ an observation point may be considered in free space. Based on this, the following result is obtained:

$$\overline{G}_{vs} = \frac{\mu}{4\pi kl}\exp\left[-\sqrt{\frac{\phi\mu cs}{k}}\, l\right] \tag{17}$$

It may be seen from Goode, P. A. and Thambynayagam, R. K. M.: "Permeability Determination with a Multiprobe Formation Tester", *SPE Formation Eval.* 7, pp. 297–303 (1992) that this is a good approximation because the wellbore shape factor approaches 1 for the vertical probe (i.e., the vertical probe is a point observation in free space).

In dimensionless form, the above equations reduce to:

$$\overline{G}_{ssD}, \overline{G}_{vvD}, \overline{G}_{hhD} = \frac{1}{4}\exp\left[-\frac{r_p}{l}\sqrt{s_D}\right] \text{ and} \tag{18}$$

$$G_{vsD} = \frac{1}{4\pi}\exp\left[-\sqrt{s_D}\right] \tag{19}$$

The approximation set forth above for the vertical probe is not as accurate when applied to the horizontal probe. If it is assumed that the probe is at a distance d in free space, then, instead of equation (17) for the vertical probe, the following is obtained for the horizontal probe:

$$\overline{G}_{hs} = \frac{\mu}{4\pi kd}\exp\left[-\sqrt{\frac{\phi\mu cs}{k}}\, d\right] \tag{20}$$

Here, the effective distance d may be approximated by the characteristic diffusion length $\pi r_w$, and as a result, equation (20) reduces to $$\overline{G}_{hs} \approx \frac{\mu}{4\pi k(\pi r_w)}\exp\left[-\sqrt{\frac{\phi\mu cs}{k}}\, \pi r_w\right] \tag{21}$$

This approximation differs from the true steady state value ($s \rightarrow 0$) by only about twenty percent. See, Goode, P. A. and Thambynayagam, R. K. M.; Permeability Determination with a Multiprobe Formation Tester," *SPE Formation Eval.* (1992) 7, p. 297–303. Therefore, this approximation is expected to have the correct qualitative and nearly the same quantitative behavior as the correct response. In dimensionless form the following is obtained $$\overline{G}_{hsD} = \frac{1}{4\pi}\exp\left[-\frac{\varepsilon}{\delta}\sqrt{s_D}\right] \tag{22}$$

Application of equation (11) now yields $$\frac{\overline{p}_{vD}}{\overline{p}_{hD}} = \exp\left[-\left(1-\frac{\varepsilon}{\delta}\right)\sqrt{s_D}\right]\frac{\left(1+\frac{k_h s_D}{4}\exp\left[-\varepsilon\sqrt{s_D}\right]\right)}{\left(1+\frac{k_v s_D}{4}\exp\left[-\varepsilon\sqrt{s_D}\right]\right)} \tag{23}$$

Figure 3:
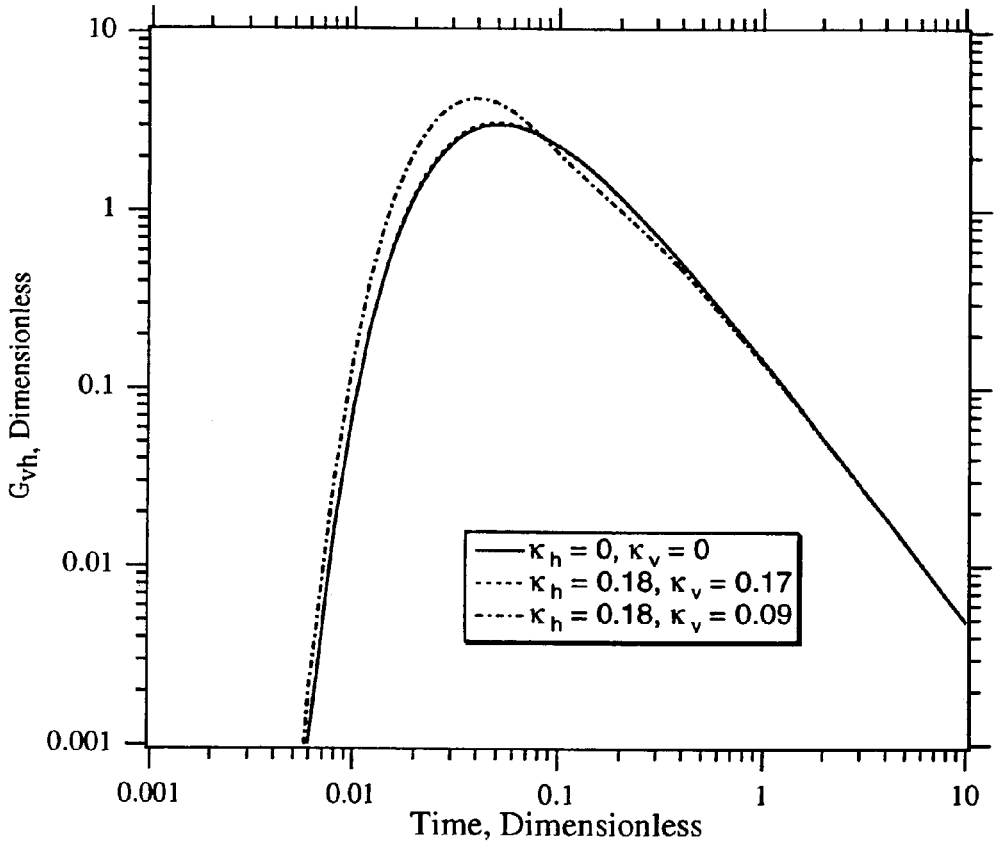
FIG. 3 is a graph showing three plots of the pressure-pressure response function for a homogeneous medium at different storage ratios.

Equation (23) allows an examination of the effect of having different storage volumes on the deconvolutional process utilized in the previously incorporated U.S. Pat. No. 5,247,830 to Goode. In particular, FIG. 3 shows the pressure-pressure response function ($G_{vhD}$ vs. time) for a homogeneous medium for observation probes having no storage ($\kappa_h$=0 and $\kappa_v$=0), for observation probes of the prior art where the horizontal probe storage volume is approximately 100 cc and the vertical probe storage volume is approximately 90 cc (corresponding to $\kappa_h$=0.18 and $\kappa_v$=0.17), and for observation probes having storage volumes such that $\kappa_h$=0.18 and $\kappa_v$=0.09. For purposes of generating the plots of FIG. 3, the formation permeability was assumed to be 10 mD, length l=70 cm, and $r_p$=0.556 cm. As seen from FIG. 3, in a homogeneous formation, the deviation from the no-storage volume reference curve is minimal for the tool of the prior art. The deviation is somewhat larger where $\kappa_h$=0.18 and $\kappa_v$=0.09. In this case, because of the smaller storage volume in the vertical probe, there is a tendency for the vertical probe to lead the horizontal probe in comparison to the true response. Clearly, this can lead to a misinterpretation that the formation is anisotropic. Thus, according to the invention, it is desirable that the storage volumes at the observation probes be equal to each other (thereby reducing the right hand fraction term of equation (23) to one).

The impact of storage compensation in a heterogeneous medium is substantially larger than the impact in a homogeneous medium. This may be illustrated by first assuming a background homogeneous medium and by assuming that in the vicinity of the horizontal and vertical probes the formation permeabilities are $k_1$ and $k_2$ respectively. Thus, the self-response functions are determined by $k_1$ and $k_2$. But $G_{vs}$ and $G_{hs}$ are based on the homogeneous permeability. As a result, equation (23) becomes $$\frac{\bar{p}_{vD}}{\bar{p}_{hD}} = \exp\left[-\left(1-\frac{\varepsilon}{\delta}\right)\sqrt{s_D}\right]\frac{\left(1+\frac{\kappa_h s_D k}{4k_1}\exp\left[-\varepsilon\sqrt{\frac{ks_D}{k_1}}\right]\right)}{\left(1+\frac{\kappa_v s_D k}{4k_2}\exp\left[-\varepsilon\sqrt{\frac{ks_D}{k_2}}\right]\right)} \tag{24}$$

It is evident that the right-hand fraction term of equation (24) cannot be reduced to one simply by choosing $\kappa_h=\kappa_v$. In fact, no universal solution is possible since it is impossible to adjust $\kappa_h$ and $\kappa_v$ to such that the storage effect is cancelled perfectly at all times. However, a practical solution is achieved by recognizing that the function $G_{vv}$ and $G_{hh}$ reach steady state much faster than $G_{vh}$ (due to the fact that $r_p/1<<1$). As a result, a near-cancellation is achieved by choosing $\kappa_h$ and $\kappa_v$ to be proportional to $k_1$ and $k_2$ respectively. Mathematically, this is expressed by:

$$\begin{aligned}\frac{\bar{p}_{vD}}{\bar{p}_{hD}} &= \exp\left[-\left(1-\frac{\varepsilon}{\delta}\right)\sqrt{s_D}\right]\frac{\left(1+\frac{\kappa_h s_D k}{4k_1}\exp\left[-\varepsilon\sqrt{\frac{ks_D}{k_1}}\right]\right)}{\left(1+\frac{\kappa_v s_D k}{4k_2}\exp\left[-\varepsilon\sqrt{\frac{ks_D}{k_2}}\right]\right)} \\ &\approx \exp\left[-\left(1-\frac{\varepsilon}{\delta}\right)\sqrt{s_D}\right]\frac{\left(1+\frac{\kappa_h s_D k}{4k_1}\right)}{\left(1+\frac{\kappa_v s_D k}{4k_2}\right)}\end{aligned} \tag{25}$$

Figure 4:
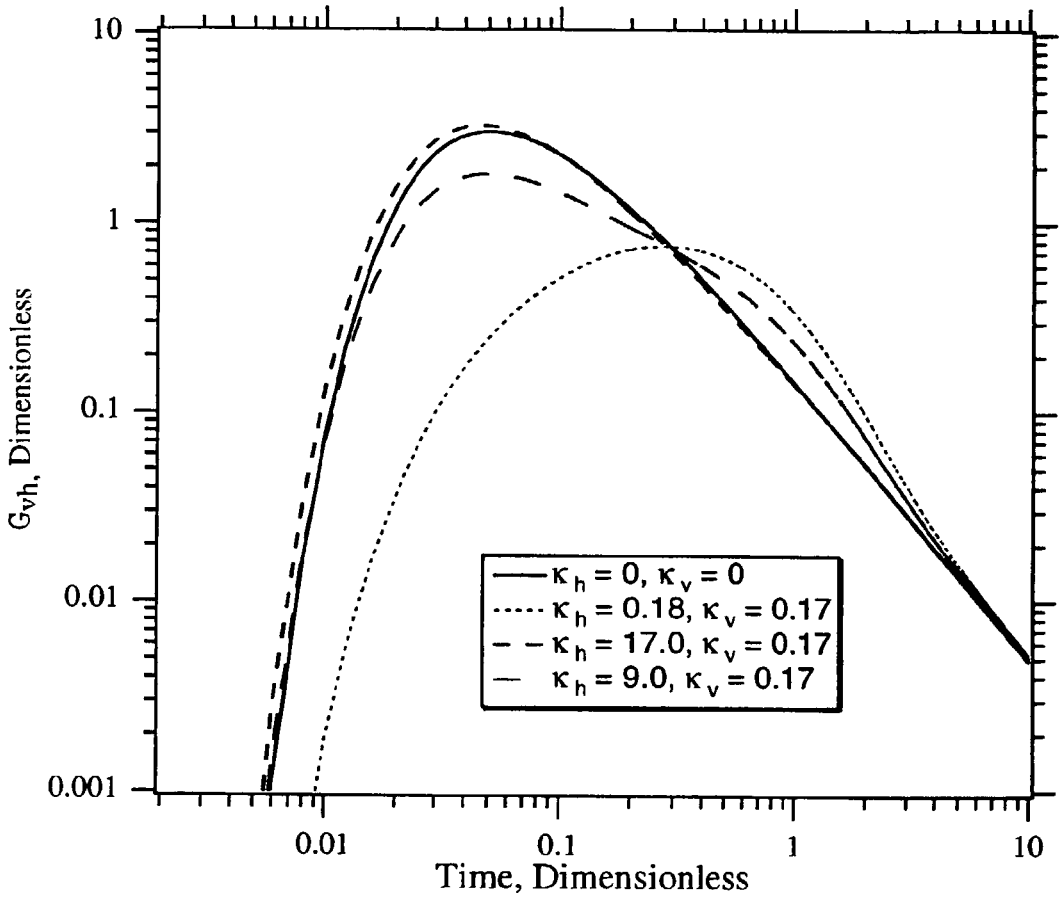
FIG. 4 is a graph showing four plots of the pressure-pressure response function for a heterogeneous medium at different storage ratios.

Equation (25) allows an examination of the effect of using different storage volumes on the deconvolution process with respect to heterogeneous formations. Using the same example used with respect to FIG. 3 (i.e., 1=70 cm, and $r_p$=0.556 cm), it is assumed that the background permeability is 10 mD and the permeability at the horizontal probe is 100 mD, while the permeability at the vertical probe is 1 mD. In particular, FIG. 4 shows the pressure-pressure response function ($G_{vhD}$ vs. time) for the heterogeneous medium. A reference response plot is set for observation probes having no storage ($\kappa_h$=0 and $\kappa_v$=0). A second plot for observation probes of the prior art where the horizontal probe storage volume is approximately 100 cc and the vertical probe storage volume is approximately 90 cc (corresponding to $\kappa_h$=0.18 and $\kappa_v$=0.17) is seen to be significantly displaced from the reference plot. However, adjusting the horizontal probe storage volume to one hundred times that of the vertical probe storage (based on the local permeability ratio) so that $\kappa_h$=17.0 and $\kappa_v$=0.17 is seen in FIG. 4 to essentially eliminate the displacement. Even partial compensation significantly improves the character of the response as can be seen from the plot where $\kappa_h$=9.0.

There have been described and illustrated herein several embodiments of apparatus and methods for investigating properties of an earth formation traversed by a borehole. While particular embodiments of the invention have been described, it is not intended that the invention be limited thereto, as it is intended that the invention be as broad in scope as the art will allow and that the specification be read likewise. Thus, while a downhole tool having three probes was described, it will be appreciated that other numbers of probes could be utilized. Also, while a tool which permits probe fluid storage volume to be increased by a factor of about one hundred was described, it will be appreciated that the increase in probe fluid storage volume could be significantly smaller or significantly larger depending upon the accuracy of measurements desired and the formations likely to be encountered. Further, while it is preferred that the horizontally and vertically displaced probes have identical flow line characteristics, it will be appreciated that such an arrangement is only preferred, as given the flexibility associated with the branch flow lines, it will typically be possible to arrange the probes so that the flow line storage volumes are equal for homogeneous formations or portions thereof. It will therefore be appreciated by those skilled in the art that yet other modifications could be made to the provided invention without deviating from its spirit and scope as claimed.

We claim:

1. An apparatus for the investigation of an earth formation traversed by a borehole, comprising:

a) a first probe including means for injecting fluid into the formation or withdrawing fluid from the formation;

b) a second probe vertically displaced relative to the first probe and in fluid contact with the formation, said second probe including a first fluid flow line and a first pressure measurement means for measuring pressure in said first fluid flow line which results from the fluid being injected into the formation or obtained from the formation by the first probe; and c) a third probe azimuthally displaced relative to the first probe and in fluid contact with the formation, said third probe including a second fluid flow line and a second pressure measurement means for measuring pressure in said second fluid flow line which results from the fluid being injected into the formation or obtained from the formation by the first probe, wherein said first fluid flow line has a first storage volume, said second fluid flow line has a second storage volume, and at least one of said second probe and said third probe includes means for adjusting at least one of said first volume and said second volume, said means for adjusting being controlled to reduce storage effects on interpretation of data obtained from said second probe and said third probe.

2. An apparatus according to claim 1, wherein:

both said second probe and said third probe includes means for adjusting at least one of said first volume and said second volume.

3. An apparatus according to claim 2, wherein:

said means for adjusting said first volume comprises a plurality of first branch flow lines coupled to said first flow line by a first plurality of valves.

4. An apparatus according to claim 3, wherein:

said means for adjusting said second volume comprises a plurality of second branch flow lines coupled to said second flow line by a second plurality of valves.

5. An apparatus according to claim 3, wherein:

said plurality of first branch flow lines have a plurality of branch flow line volumes which are equal one to the other.

6. An apparatus according to claim 3, wherein:

said plurality of first branch flow lines have a plurality of branch flow line volumes which are unequal to each other.

7. An apparatus according to claim 6, wherein:

said plurality of branch flow line volumes are related to each other by factors of two.

8. An apparatus according to claim 3, wherein:

said means for adjusting said first volume includes means for adjusting said first volume by at least a factor of ten.

9. An apparatus according to claim 1, wherein:

said first storage volume and said second storage volume are equal.

10. An apparatus according to claim 1, wherein:

said second probe includes pretest means for obtaining fluids from the formation, and said third probes includes pretest means for obtaining fluids from the formation.

11. An apparatus for the investigation of an earth formation traversed by a borehole, comprising:

a) a first probe including means for injecting fluid into the formation or withdrawing fluid from the formation;

b) a second probe vertically displaced relative to the first probe and in fluid contact with the formation, said second probe including a first fluid flow line and a first pressure measurement means for measuring pressure in said first fluid flow line which results from the fluid being injected into the formation or obtained from the formation by the first probe;

c) a third probe azimuthally displaced relative to the first probe and in fluid contact with the formation, said third probe including a second fluid flow line and a second pressure measurement means for measuring pressure in said second fluid flow line which results from the fluid being injected into the formation or obtained from the formation by the first probe, and d) means for estimating permeability of the formation adjacent said second probe and adjacent said third probe, wherein said first fluid flow line has a first storage volume, said second fluid flow line has a second storage volume, and at least one of said second probe and said third probe includes means for adjusting at least one of said first volume and said second volume, and said means for estimating permeability causing said means for adjusting at least one of said first volume and said second volume to adjust at least one of said first volume and said second volume.

12. An apparatus according to claim 11, further comprising:

means for utilizing pressures measured at said second and third probes to determine values over time of a function G(t) which is a function of the geometry and rock and fluid properties of the formation but is independent of the manner in which the pressure or fluid flow is varied at said first probe, wherein said function is related to the hydraulic property of said formation.

13. An apparatus for the investigation of an earth formation traversed by a borehole, comprising:

a) a first probe including means for injecting fluid into the formation or withdrawing fluid from the formation;

b) a second probe vertically displaced relative to the first probe and in fluid contact with the formation, said second probe including a first fluid flow line and a first pressure measurement means for measuring pressure in said first fluid flow line which results from the fluid being injected into the formation or obtained from the formation by the first probe;

c) a third probe azimuthally displaced relative to the first probe and in fluid contact with the formation, said third probe including a second fluid flow line and a second pressure measurement means for measuring pressure in said second fluid flow line which results from the fluid being injected into the formation or obtained from the formation by the first probe, and d) means for estimating a ratio of a permeability of the formation adjacent said second probe and a permeability of the formation adjacent said third probe, wherein said first fluid flow line has a first storage volume, said second fluid flow line has a second storage volume, and at least one of said second probe and said third probe includes means for adjusting at least one of said first volume and said second volume, and said means for estimating a ratio causing said means for adjusting at least one of said first volume and said second volume to adjust at least one of said first volume and said second volume such that a ratio of said first volume to said second volume is substantially equal to a ratio of said permeability.

14. An apparatus according to claim 13, further comprising:

means for utilizing pressures measured at said second and third probes to determine values over time of a function G(t) which is a function of the geometry and rock and fluid properties of the formation but is independent of the manner in which the pressure or fluid flow is varied at said first probe, wherein said function is related to the hydraulic property of said formation.

15. A method for investigating an earth formation traversed by a borehole utilizing an apparatus having a first probe having means for injecting fluid into the formation or withdrawing fluid from the formation, a second probe vertically displaced relative to the first probe and in fluid contact with the formation and having a first fluid flow line having a first storage volume and a first pressure measurement means, and a third probe azimuthally displaced relative to the first probe and in fluid contact with the formation and having a second fluid flow line having a second storage volume and a second pressure measurement means, the method comprising:

a) adjusting one of said first storage volume and second storage volume to obtain a desired ratio of said first volume and second;

b) injecting fluid into or withdrawing fluid from the formation through the first probe; and c) measuring pressures at the second and third probes resulting from said injecting or withdrawing, wherein said adjusting adjusts one of said first storage volume and second storage volume in order to reduce storage effects on interpretation of pressure data obtained from said second probe and said third probe.

16. A method according to claim 15, further comprising:

d) estimating a first permeability of the formation adjacent the second probe and a second permeability of the formation adjacent the third probe prior to said adjusting, wherein said adjusting comprises altering at least one of said first storage volume and second storage volume such that a ratio of said first storage volume and said second storage volume is substantially equal to a ratio of said estimate of a first permeability and said estimate of a second permeability.

17. A method according to claim 15, wherein:

said first fluid flow line comprises a first main line and a plurality of first branch flow lines coupled to the first main line via a plurality of first valves, and said second fluid flow line comprises a second main line and a plurality of second branch flow lines coupled to the second main line via a plurality of second valves, and said adjusting comprises opening or closing at least one of said plurality of first valves or plurality of second valves.

18. A method according to claim 15, further comprising:

priming at least a portion of said first fluid flow line and at least a portion of said second fluid flow line prior with substantially identical fluids prior to said adjusting.

19. A method according to claim 18, wherein:

said priming comprises flushing at least a portion of said first fluid flow line and at least a portion of said second fluid flow line with either formation fluids or with fluids carried by the apparatus into the borehole.

20. A method according to claim 18, wherein:

said priming comprises filling at least a portion of said first fluid flow line and at least a portion of said second fluid flow line with fluids prior to placing the apparatus into the borehole.

21. A method according to claim 15, further comprising:

from the pressures measured by the second and third probes, determining values over time of a function G(t) which is a function of the geometry and rock and fluid properties of the formation but is independent of the manner in which the pressure or fluid flow is varied at the first probe, wherein the function is related to a hydraulic property of the formation.

* * * * *